United States Patent [19]

Schuster

[11] 3,987,805

[45] Oct. 26, 1976

[54] HAIR CURLER

[75] Inventor: Wilhelm Schuster, Frankfurt am Main, Germany

[73] Assignee: Griso-Chemie AG, Landquart, Switzerland

[22] Filed: Feb. 25, 1974

[21] Appl. No.: 445,499

[30] Foreign Application Priority Data

Feb. 27, 1973 Germany ..... 2309650

[52] U.S. Cl. ..... 132/40

[51] Int. Cl.[2] ..... A45D 2/00

[58] Field of Search ..... 132/40, 42, 33, 9

[56] References Cited

UNITED STATES PATENTS

| | | | |
|---|---|---|---|
| 2,582,550 | 1/1952 | Madore | 132/33 |
| 3,144,027 | 8/1964 | Chalfin et al. | 132/40 |
| 3,216,427 | 11/1965 | Jefferson | 132/40 |
| 3,267,942 | 8/1966 | Mestral | 132/40 |
| 3,529,608 | 9/1970 | Mates | 132/40 |
| 3,533,418 | 10/1970 | Mestral | 132/40 |

*Primary Examiner*—G.E. McNeill

*Attorney, Agent, or Firm*—Kurt Kelman

[57] ABSTRACT

A self-adhering hair curler comprises an elongated cylindrical foam body and equidistantly spaced elongated strips of bristles bonded to the peripheral surface of the body and extending longitudinally thereof.

10 Claims, 2 Drawing Figures

HAIR CURLER

Figure 1:
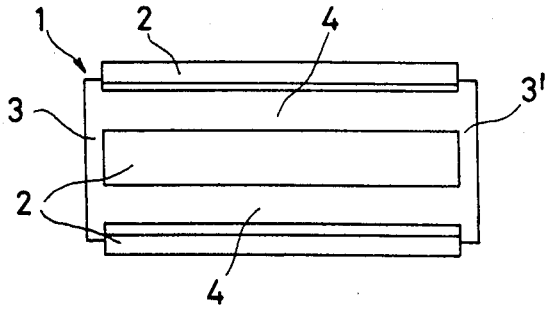

The present invention relates to improvements in self-adhering hair curlers comprising an elongated cylindrical body of synthetic resin foam.

Hair curlers of various types have been placed on the market. Most of them are made of a relatively rigid material, such as metal mesh or perforated synthetic resin sheet, formed into a substantially cylindrical tubular roller. After the hair is curled about such rollers, they are kept in place by hair pins or the like. It has also been proposed to provide hair curlers with a roughened surface to facilitate the curling and reduce slippage of the roller in respect of the hair. For instance, a relatively stiff bristle material was placed into the axial bore of the curler so that the bristle ends protrude radially through the openings of the metal mesh or perforated plastic sheet, thus providing a rough roller surface. However, such rollers, too, must be kept in place by hair pins or the like.

Other types of hair curlers have also been proposed in an effort to make them self-adherent but all of them have at least some disadvantage, such as high cost, poor adherence and/or stiffness of the curler material, which may cause considerable pressure and pain, particularly if the wearer of the hair curlers rests her head on a pillow or other support. Furthermore, if stiff hair curlers are used frequently, they will cause brittleness in the hair because they tension the curled hair non-elastically.

To avoid the latter disadvantage, it has been proposed to provide a synthetic resin foam layer on the surface of the curler. However, this has not been a satisfactory solution because the foam layer is pressed against the rigid curler surface and loses its elasticity after a short time.

This has led to the development of hair curlers whose entire cylindrical bodies consist of an elastic material with a rough surface. A soft elastic foam with large open pores, such as used for technical filtering purposes, has been used for such hair curlers. After the hair is curled about such soft elastic curlers, they are held in place by inserting a pin therethrough. Thus, while the curler itself is elastic, the holding pin must be rigid, of course. Inserting of the pin through the curler often requires several attempts because certain portions of the curler material may be resistant to ready penetration. In addition and particularly when the wearer rests her head on a pillow and moves it from side to side, the soft elastic curler may be displaced and the holding pin may penetrate through the skin of the head.

It is the primary object of this invention to overcome the various disadvantages of known hair curlers and to provide a self-adherent curler which has no rigid or stiff parts at all, is simple and safe to handle and apply, and is very inexpensive.

This and other objects are accomplished in accordance with the invention by bonding substantially equidistantly spaced elongated strips of bristle material to the peripheral surface of an elongated cylindrical body of synthetic resin foam, the strips extending longitudinally of the body.

The spacing between the individual strips and the density of the foam as the cylindrical body are so selected in relation to each other that the curler is compressible to a volume of about one third of the original volume thereof. This imparts an optimum expansion tension to the curler, which is neither too small nor too strong and thus holds the curled hair under desirable tension without subjecting it to undue force and damaging it.

Figure 2:
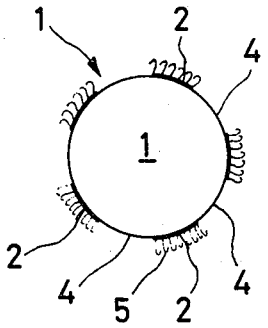

The above and other objects, advantages and features of the present invention will become more apparent from the following detailed description of a now preferred embodiment thereof, taken in conjunction with the accompanying drawing wherein FIG. 1 is a side elevational view of a hair curler according to this invention and FIG. 2 is an end view thereof.

Referring now to the drawing, the curler is shown to comprise a solid elongated cylindrical body 1 of a soft elastic synthetic resin foam. Substantially equidistantly spaced elongated strips 2 of bristle material are bonded to the perpheral surface of body 1 and extend longitudinally thereof. Preferably, all strips are of substantially the same length and width, spacings 4 between the strips also being of equal width.

Hair curlers are produced with different diameters to be used with hair of different length. In one embodiment, for instance, the hair curlers of this invention may have a diameter of 27 mm, in which case five strips 2 of 8 mm width may be bonded to the peripheral surface of body 1 at spacings of 9 mm. While certain changes in the widths of the strips and the spacings therebetween are possible, it is important that the spacing between the strips is at least as wide as the strips and that the spacing does not exceed about 15 mm. These relationships are necessary to maintain the required compressibility of the curler.

It has been found that the curler should be compressible to a volume of about one third of the original volume thereof. If it is softer, i.e. if it is compressible to a volume of less than one third of the original volume, it would create too strong an expansion tension on the curled hair. The compressibility of the curler depends not only on the width relationship between strips 2 and spacings 4 but also on the nature of the foam of which body 1 is made, in which respect the density of the foam plays the largest role. Good results have been obtained with polyurethane and like foams having a density between about 45 and 65 kg/cu.m., preferably about 55 kg/cu.m. The number and width of the strips and the spacings therebetween will depend on the diameter of the cylindrical body of the curler.

Preferably, the strip length is somewhat shorter than the length of cylindrical body 1 to leave free rims 3, 3' of the peripheral surface along the respective ends of the body. This protects the edges of the curler and has proven to be quite advantageous.

Bristle materials useful for strips 2 are known in a variety of forms. The material may comprise short bristles which extend perpendicularly or obliquely so that the bristles extend substantially radially or in a chordal direction from the peripheral surface of the cylindrical body when the strips are bonded thereto. It will be useful and increase the adherence of the curlers to the hair if the free ends of the bristles are hook-shaped, i.e. if the ends 5 are bent over or have a mushroom shape. When the curler is compressed during curling, the bristles are pressed into the strands of hair and adhere thereto.

The hair curler of the present invention is soft and elastic. It is self-adherent and requires no pins or other means for holding it in the hair. It is held strongly in place and will not be displaced during rest or sleep.

Since the tension exerted upon the curled hair by the curler is controlled to a desired extent, the curled hair will fall loosely after combing. The hair is never tensioned too much and is not pressed against hard or rigid curler parts so that it will not be damaged even after prolonged and repeated use of such curlers. Finally, the manufacture of these curlers is cheap, which makes mass production possible.

What is claimed is:

1. A self-adhering hair curler comprising an elongated cylindrical body of resiliently compressible synthetic resin foam and substantially equidistantly spaced elongated strips of bristle material bonded to the peripheral surface of the body and extending longitudinally thereof.

2. The hair curler of claim 1, wherein the spacing between the strips is at least as wide as the strips, the spacing not exceeding about 15 mm.

3. The hair curler of claim 1, wherein the density of the synthetic resin foam is between about 45 to 65 kg/cu.m.

4. The hair curler of claim 1, wherein the curler is compressible to a volume of about one third of the original volume thereof.

5. The hair curler of claim 1, wherein the elongated strips are of substantially the same length, the strip length being somewhat shorter than the length of the cylindrical body to leave free rims of the peripheral surface along the respective ends of the cylindrical body.

6. The hair curler of claim 1, wherein the bristles extend substantially radially from the peripheral surface of the cylindrical body.

7. The hair curler of claim 1, wherein the bristles extend in a chordal direction from the peripheral surface of the cylindrical body.

8. The hair curler of claim 1, wherein the ends of the bristles are hook-shaped.

9. The hair curler of claim 1 wherein said body is solid.

10. The hair curler of claim 3, wherein the density of the synthetic resin foam is about 55 kg/cu.m.

* * * * *